US005181789A

United States Patent [19]

Blair

[11] Patent Number: 5,181,789

[45] Date of Patent: Jan. 26, 1993

[54] PRINTER RIBBON GUIDE ASSEMBLY

[75] Inventor: Blaise G. Blair, Post Falls, Id.

[73] Assignee: Output Technology Corporation, Spokane, Wash.

[21] Appl. No.: 718,631

[22] Filed: Jun. 21, 1991

[51] Int. Cl.[5] ..... B41J 35/04

[52] U.S. Cl. ..... 400/248; 400/247

[58] Field of Search ..... 400/248, 248.3, 247, 400/174, 175

[56] References Cited

U.S. PATENT DOCUMENTS

| | | | |
|---|---|---|---|
| 835,722 | 11/1906 | Anderson | 400/250 |
| 1,591,243 | 4/1926 | Smith | 400/250 |
| 2,518,893 | 8/1950 | Huether | 400/248 |
| 2,788,111 | 2/1957 | Spiegel | 400/250 |
| 2,838,156 | 6/1958 | Griffith | 400/174 |
| 2,895,586 | 5/1959 | Di Luco | 400/250 |
| 2,969,864 | 1/1961 | Holgate | 400/175 |
| 3,047,121 | 7/1962 | Roggenstein | 400/250 |
| 3,986,593 | 10/1976 | Orlens et al. | 400/175 |
| 4,110,050 | 8/1978 | Wood et al. | 400/248 |
| 4,285,604 | 8/1981 | Rex | 400/247 |
| 4,504,160 | 3/1985 | Payne et al. | 400/196.1 |
| 4,650,355 | 3/1987 | Cassiano et al. | 400/248 |
| 4,806,948 | 2/1989 | Bangs et al. | 400/248 |

FOREIGN PATENT DOCUMENTS 488569 5/1970 Switzerland .

OTHER PUBLICATIONS

IBM Technical Disclosure Bulletin vol. 29 No. 9 Feb. 1987 "Ink Smudge Prevention/Acoustic Noise Dampening Design for a Dot Matrix".

Prior art ribbon guide assembly for use in a multi-head printer which is manufactured by Output Technology Corporation is shown in FIGS. 1 and 2, and is described in the "Background of the Invention" in the application.

*Primary Examiner*—David A. Wiecking
*Assistant Examiner*—L. Hendrickson
*Attorney, Agent, or Firm*—Wells, St. John, Roberts, Gregory & Matkin

[57] ABSTRACT

The present invention relates to a ribbon guide assembly for a printer. A ribbon guide assembly (40) includes a ribbon guide (50) and a guide support (45). The ribbon guide (50) is employed on a replaceable printer ribbon cartridge to guide an exposed print section of a print ribbon (64) over a print head (80) of the printer. The ribbon guide (50) of the present invention has four members (56, 58, 60, 62) disposed between a bottom platform (52) and a top platform (54), whereby the members define a path for the print ribbon. The ribbon guide also has two collars (66, 68) coupled to the bottom platform and two of the members. Each of the collars defines a substantially circular opening. The guide support (45), affixed to the print head carriage, has two cylindrical alignment rods (90, 92) extending upward substantially perpendicular from the path of the carriage. The alignment rods (90, 92) of the print head are adapted to be inserted through the openings defined by the collars (66, 68) of the ribbon guide to securely support the ribbon guide.

13 Claims, 6 Drawing Sheets

PRINTER RIBBON GUIDE ASSEMBLY

TECHNICAL FIELD

This invention relates to computer printers, and more particularly, to ribbon guide assemblies for computer printers.

BACKGROUND OF THE INVENTION

Computer printers commonly employ single or multiple print heads positioned on a reciprocating print head carriage. A printer ribbon cartridge used in computer printers includes one or more ribbon guides—a device which guides the print ribbon over a printing surface of a print head—which attach to the print heads.

A conventional three ribbon guide arrangement for a three-head printer is shown in FIG. 1. The ribbon guides 22*a*, 22*b*, and 22*c* are mounted on a conventional printer ribbon cartridge 10 having a cartridge housing 12 which houses and protects a continuous print ribbon 14. The cartridge housing 12 includes a housing body 16 and two guide arms 18 and 20. The housing body 16 stores the bulk of the continuous print ribbon 14. The two guide arms 18 and 20 extend substantially perpendicular from the housing body 16 to support and guide the print ribbon 14 from the housing body 16. An exposed print section of the print ribbon 14 extends between the two guide arms 18 and 20. The three ribbon guides 22*a*, 22*b*, and 22*c* are slidably coupled to the exposed print section of the print ribbon 14. The ribbon guides 22*a*, 22*b*, and 22*c* attach to complementary guide supports on respective print heads of the printer (not shown) to guide the print ribbon 14 over the print heads.

One conventional ribbon guide assembly having the ribbon guide 22*a* and a print head 24 is shown in FIG. 2. The ribbon guide 22*a* has a rear section 25 and a central section 28. The rear section 25 and the central section 28 are open at the bottom of the ribbon guide 22*a* as illustrated generally by reference numeral 27. The rear section 25 has two rectangular grooves 26 formed in each side. The central section 28 also has two rectangular grooves 30 formed in each side.

The ribbon guide has a front section that includes upper ribbon guide elements 32 (only one element is shown in this perspective view) and lower ribbon guide elements 36*a* and 36*b*. The upper ribbon guide elements 32 is formed adjacent the central section 28 and extends downward over the print ribbon 14. The lower ribbon guide elements 36*a* and 36*b* are supported by a pair of triangular flanges 38 (only the near side is shown) formed along the bottom of the central section 28 and extend upward over the print ribbon 14. The depicted triangular lip 38 extends outward at an angle from a position flush with an edge 29 of the central section 28. The upper ribbon guide elements 32 and the lower ribbon guide elements 36*a* and 36*b* define a path for the print ribbon 14.

The print head 24 has a nose section 40 with guide supports in the form of first rectangular flange 42 and second rectangular flange 44. The nose section 40 contains plural pin wires and pin wire guides (not shown). The pin wires are directed through the nose section 40 on the pin wire guides to a linear array at the front 46 of the print head 24. The first flange 42 has a width which is slightly less than the width of the grooves 26 of the rear section 25 of the ribbon guide 22*a*. The second flange 44 has a width which is slightly less than the width of the grooves 30 of the central section 28. As a result, the ribbon guide 22*a* may be mounted on to the print head 24 by aligning the support grooves 26 and 30 with the first and second flanges 42 and 44, respectively, and then sliding the ribbon guide 22*a* onto the print head 24. Once mounted, the ribbon guide 22*a* guides the print ribbon 14 over the linearly arrayed pin wires at the front 46 of the print head 24.

One of the problems associated with the above described ribbon guide assembly is that the ribbon guide is mounted on the nose section of the print head which can provide additional stresses on the print head, not only during installation of the ribbon guide, but also during operation. Additionally, it is more difficult to mount securely the ribbon guide on the guide supports.

One of the objects and advantages of the present invention is the provision of a ribbon guide assembly that does not provide additional stresses on the print heads and is easier to assemble and disassemble.

BRIEF DESCRIPTION OF THE DRAWINGS

One or more preferred embodiments of the invention are illustrated in the accompanying drawings, which are briefly described below.

DETAILED DESCRIPTION OF THE PREFERRED EMBODIMENTS

This disclosure of the invention is submitted in furtherance of the constitutional purposes of the Patent Laws "to promote the progress of science and useful arts" (Article 1, Section 8).

Figure 1:
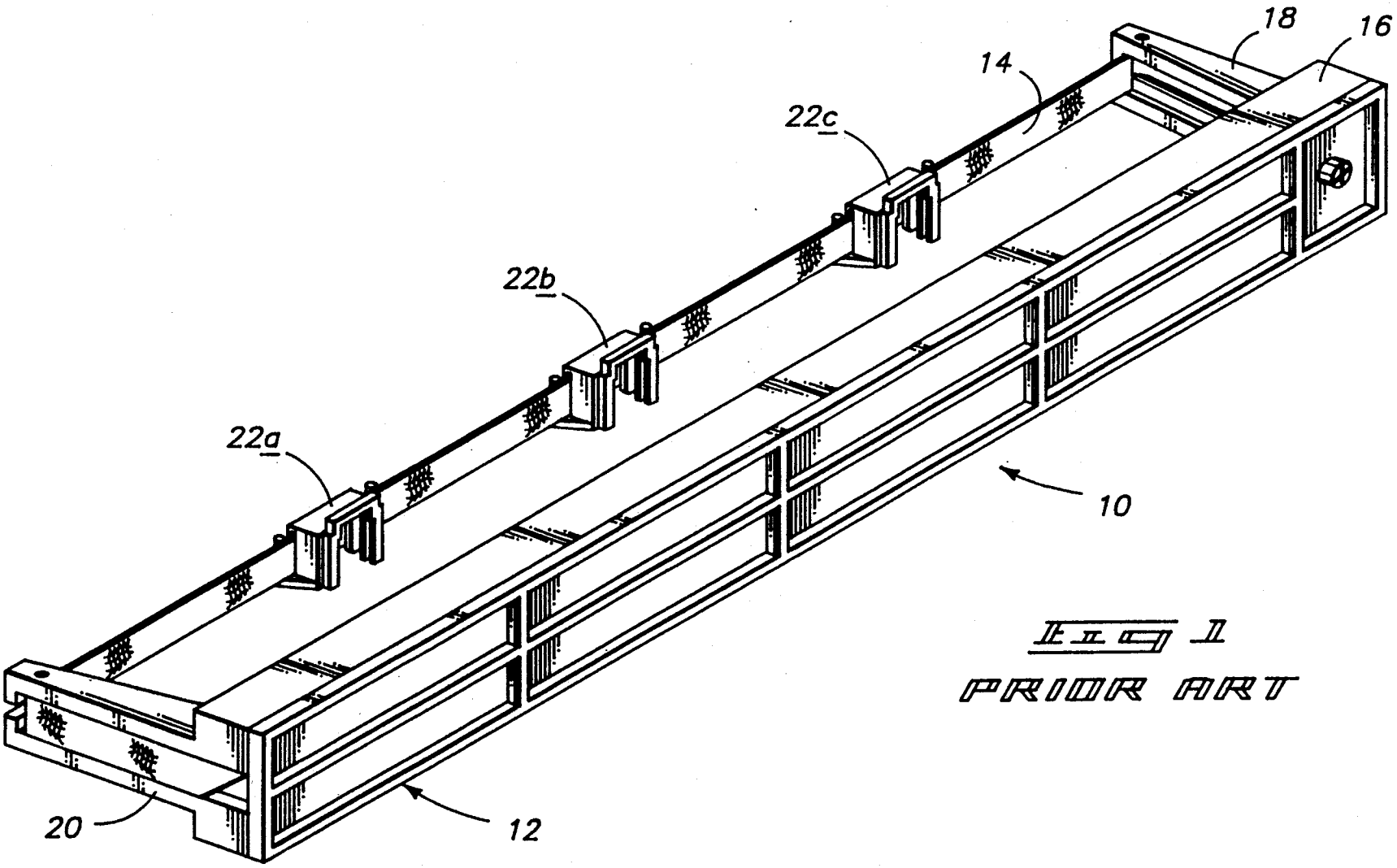
FIG 1 PRIOR ART
FIG. 1 is a perspective view of a conventional ribbon guides mounted on a replaceable printer ribbon cartridge for a multi-head printer.
Figure 2:
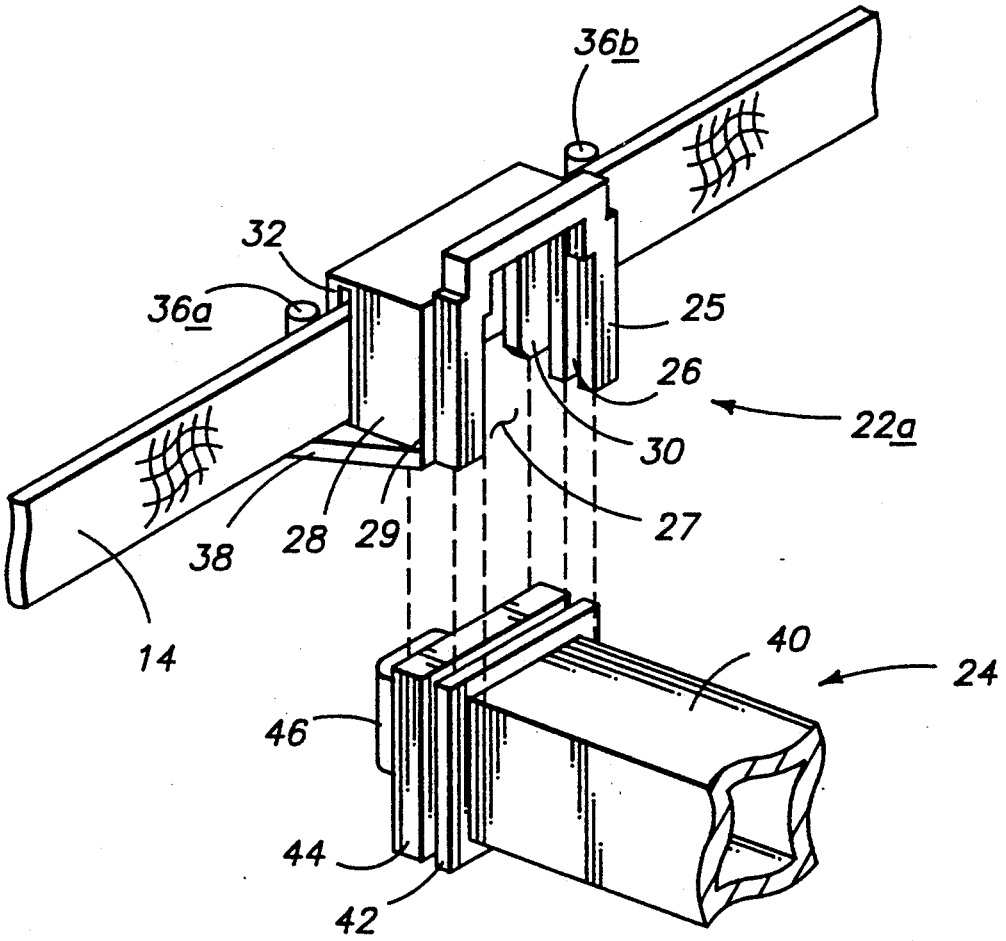
Fig 2 PRIOR ART
FIG. 2 is a fragmentary exploded perspective view of a conventional ribbon guide assembly with one conventional ribbon guide and one guide support on a print head of a multi-head printer.
Figure 3:
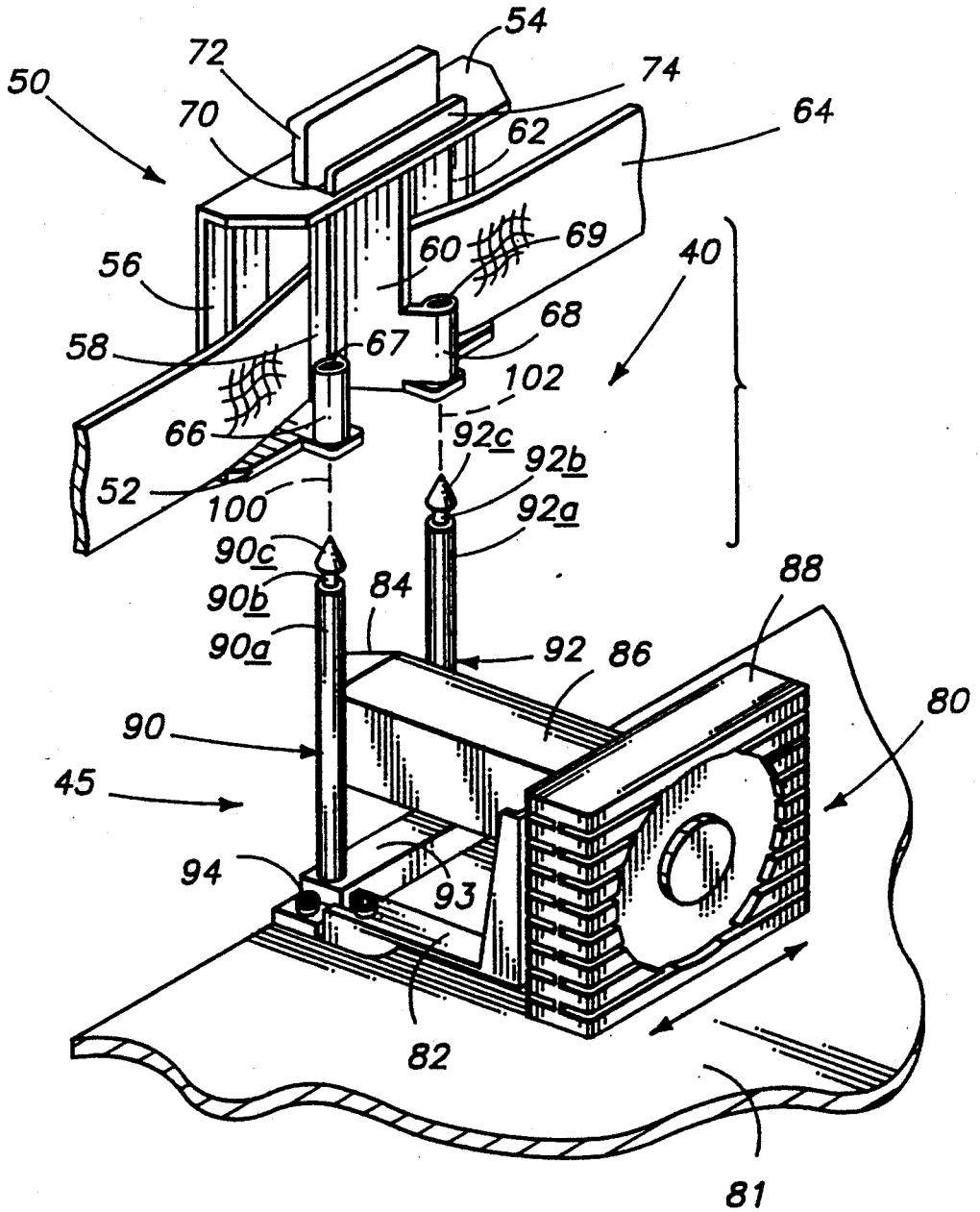
FIG. 3 is a fragmentary exploded perspective view of a preferred embodiment of a ribbon guide assembly according to the present invention.

FIG. 3 shows a ribbon guide assembly 40 and a print head 80 according to the present invention. The assembly 40 includes a ribbon guide 50 and a guide support 45.

The ribbon guide 50 has a bottom platform 52, a top platform 54, and four members 56, 58, 60, and 62. To assist in describing the preferred embodiment of the present invention, the following description assumes that the bottom platform 52 and the top platform 54 lie in horizontal planes. The top platform 54 is spaced from, and substantially parallel to, the bottom platform 52.

The four members 56, 58, 60, and 62 are vertically disposed between the bottom platform 52 and the top platform 54. Assuming that the member 56 is aligned in a first vertical plane, the member 58 is aligned in a second vertical plane at an angle from the first vertical plane. Similarly, assuming that the member 62 is aligned in a third vertical plane, the member 60 is aligned in a fourth vertical plane at an angle from the third vertical plane. The members 58 and 60 define a vertical printing gap (not shown in the perspective view of FIG. 3). According to the alignment of the members 56, 58, 60, and 62, a print ribbon 64 is woven between the members 56 and 58, over the printing gap, and between the members 60 and 62.

In the preferred embodiment, the ribbon guide 50 is permanently mounted on the print ribbon 64 so that each time a ribbon is replaced, the ribbon guide 50 is also replaced. In an alternative embodiment, however, the ribbon guide 50 may be detachable from the print ribbon 64.

Although the preferred embodiment employs relatively flat members 56, 58, 60, and 62, the members may have other shapes, such as cylindrical.

The ribbon guide 50 further includes two cylindrically-shaped collars 66 and 68 which extend upward from the bottom platform 52 along vertical axes 100 and 102. The collars 66 and 68 define substantially circular openings 67 and 69, respectively. The collars 66 and 68 are respectively coupled to members 58 and 60, and to the bottom platform 52. In other embodiments, however, the collars 66 and 68 may be coupled only to the respective members 58 and 60 or only to the bottom platform 52. The collars 66 and 68 are shown as elongated hollow cylinders, but other embodiments may include ring-like collars or C-shaped collars which define substantially circular openings.

The top platform 54 has a slot 70 formed therein. The slot 70 is aligned above the collars 66 and 68 such that the vertical axes 100 and 102 pass through the slot 70. A primary lip or projection 72 is formed adjacent one side of the slot 70 and a secondary lip or projection 74 is formed adjacent an opposing side of the slot 70. The function of the slot 70, the primary lip 72, and the secondary lip 74 will be described below in more detail.

The print head 80 is mounted on a reciprocating print head carriage 81 which moves the print head 80 back and forth during the printing process. For discussion purposes, the print head 80 is described as a print head for a dot matrix printer. However, the ribbon guide assembly 40 according to the present invention is not limited to print heads for dot matrix printers, but may be employed on print heads for other types of computer printers.

The print head 80 has a base 82, a front 84, a nose section 86, and a rear electromagnetic section 88. The print head 80 contains print pin wires (not shown) which extend from the rear section 88, through the nose section 86, to the front 84. The front 84 contains bearings which align the pin wires in a linear array. The rear casing 88 contains an electromagnetic assembly for driving the pin wires. The nose section 86 contains pin wire guides which guide the pin wires from a circular arrangement in the rear casing 88 to the linear array arrangement in the front 84. For a general description of the interior configuration of a print head for a dot matrix printer, see U.S. Pat. No. 4,895,464 to Rubinshtein, and assigned to Output Technology Corporation.

The guide support 45 preferably comprises two support and alignment rods or columns 90 and 92 which extend perpendicularly from a mount 93. In the preferred embodiment, the rods 90 and 92 are spaced on the mount 93 equal distances from respective sides of the nose section 86. The alignment rods 90 and 92 respectively include first cylindrical sections **90*a* and 92*a*, second cylindrical sections 90*b* and 92*b*, and conical sections 90*c* and 92*c* aligned along respective axes 100 and 102. The first cylindrical section 90*a* has a diameter which is larger than the diameter of the second cylindrical section 90*b*. The conical section 90*c* has at its base a diameter approximately equal to the diameter of the first cylindrical section 90*a*. Similarly, the second cylindrical section 92*a* has a diameter which is larger than the diameter of the second cylindrical section 92*b*, and the conical section 92*c* has at its base a diameter approximately equal to the diameter of the second cylindrical section 92*a***.

The guide support 45 is coupled to the carriage 81 via a screw 94.

Figure 4:
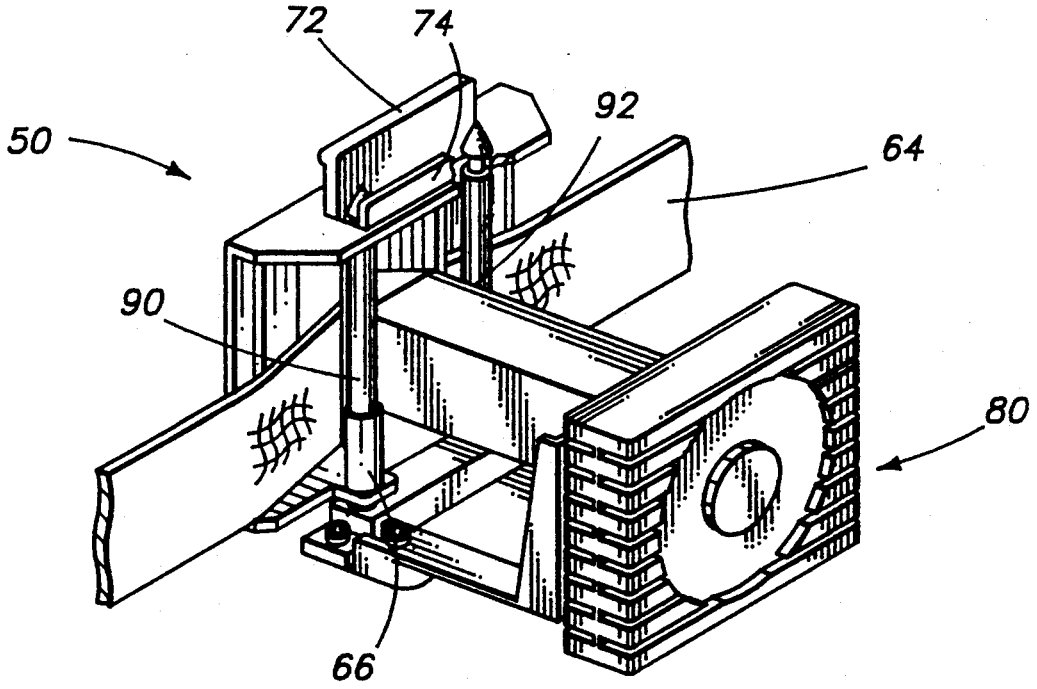
FIG. 4 is an assembled perspective view of a ribbon guide assembly illustrated in FIG. 3.

To mount the ribbon guide 50 onto the guide support 45, the collars 66 and 68 of the ribbon guide 50 are aligned above the rods 90 and 92 on opposite sides of the print head 80 as shown in FIG. 3. The rods 90 and 92 are then slid through the collars 66 and 68, respectively. The diameters of the cylindrical sections **90*a* and 92*a* of the rods 90 and 92 are such that the outer surface of the cylindrical sections 90*a* and 92*a* abut the inner surface of the collars 66 and 68, respectively. The conical sections 90*c* and 92*c* fasten or snap into the slot 70 in the top platform 54 of the ribbon guide 50 and bear against the lips 72 and 74. In this manner, the ribbon guide 50 is secured to the carriage in the desired position and orientation, as shown in FIG. 4. Once in place, the ribbon guide 50 guides the print ribbon 64 over the front 84 of the print head 80**.

When it is desired to remove the ribbon guide 50 from the guide support 45, one grips the lip 72 and pulls upward causing the sections **90*c* and 92*c* to deflect toward each other to release the rods 90 and 92 from the slot 70. The ribbon guide 50 is then moved upward and removed from the guide support 45. Removal of the ribbon guide 50 will generally occur each time a ribbon is replaced. Alternatively, the ribbon may be removed without replacing the ribbon guide 50**.

The preferred embodiment has been described as employing cylindrical collars 66 and 68 and corresponding cylindrical alignment rods 90 and 92. The present invention contemplates, however, employing other rod/collar arrangements such as a triangular rod/collar arrangement or a rectangular rod/collar arrangement.

Figure 5:
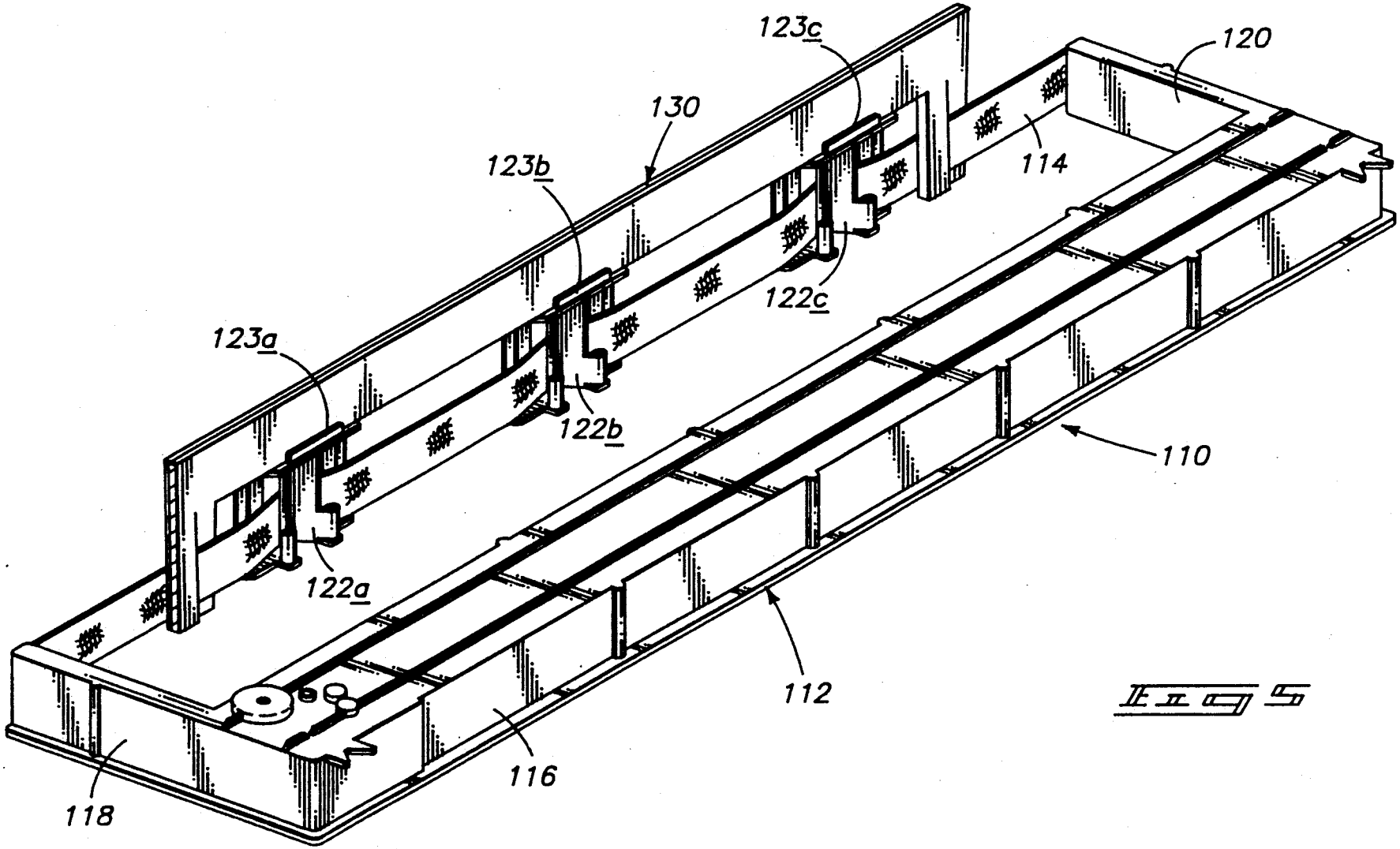
FIG. 5 is a perspective view of a printer ribbon cartridge according to the present invention.

FIG. 5 shows a computer printer ribbon cartridge 110 according to the present invention for use in a printer having three print heads. The present invention is, of course, also applicable to printer ribbon cartridges for use in printers having one, two, three, or more print heads.

The printer ribbon cartridge 110 has a cartridge housing 112 which houses and protects the print ribbon 114. The cartridge housing 112 includes a housing body 116 and two guide arms 118 and 120. The two guide arms 118 and 120 extend substantially perpendicular from the housing body 116 to support and guide the print ribbon 114 from the housing body 116 and around the print heads (not shown).

The cartridge housing 112 contains the bulk of the print ribbon 114, but a small section of the print ribbon 114 is exposed between the two guide arms 118 and 120. This exposed print section of the print ribbon 114 extends across the fronts of the print heads.

The printer ribbon cartridge 110 also includes three ribbon guides **122*a*, 122*b*, and 122*c* which are slidably coupled to the exposed print section of the print ribbon 114. The ribbon guides 122*a*, 122*b*, and 122*c* are identical to the ribbon guide 50 described with reference to FIG. 3. The number of ribbon guides 122***a*, 122*b*, and 122*c* employed on the printer ribbon cartridge 110 corresponds to the number of print heads of the printer. Therefore, for a single print head printer, the printer ribbon cartridge 110 would employ only one ribbon guide.

The printer ribbon cartridge 110 may further include a releasable ribbon guide carrier 130 which is operatively connected to the ribbon guides 122*a*, 122*b*, and 122*c*. The ribbon guide carrier 130 supports the ribbon guides 122*a*, 122*b*, and 122*c* on the exposed print section of the print ribbon 114 at distances approximately equal to preset spaced distances among the print heads of the printer. The ribbon guide carrier 130 is inserted between the primary lips (not shown) and the secondary lips 123*a*, 123*b*, and 123*c* of the ribbon guides 122*a*, 122*b*, and 122*c*. The ribbon guide carrier 130 has adhesive regions which releasably attach to the primary lips of the ribbon guides 122*a*, 122*b*, and 122*c*. The ribbon guide carrier 130 facilitates installation of the printer ribbon cartridge by guiding the ribbon guides 122*a*, 122*b*, and 122*c* onto respective print heads and then releasing the ribbon guides 122*a*, 122*b*, and 122*c* once the ribbon guides are in place.

The ribbon guide carrier 130 may not be employed with printer ribbon cartridges used in single print head printers. But, the ribbon cartridges used in multi-head printers must employ multiple ribbon guides, and thus, a ribbon guide carrier may be used to facilitate installation. Accordingly, the primary and secondary lips are provided on the ribbon guides for attachment to the ribbon guide carrier.

Figure 6:
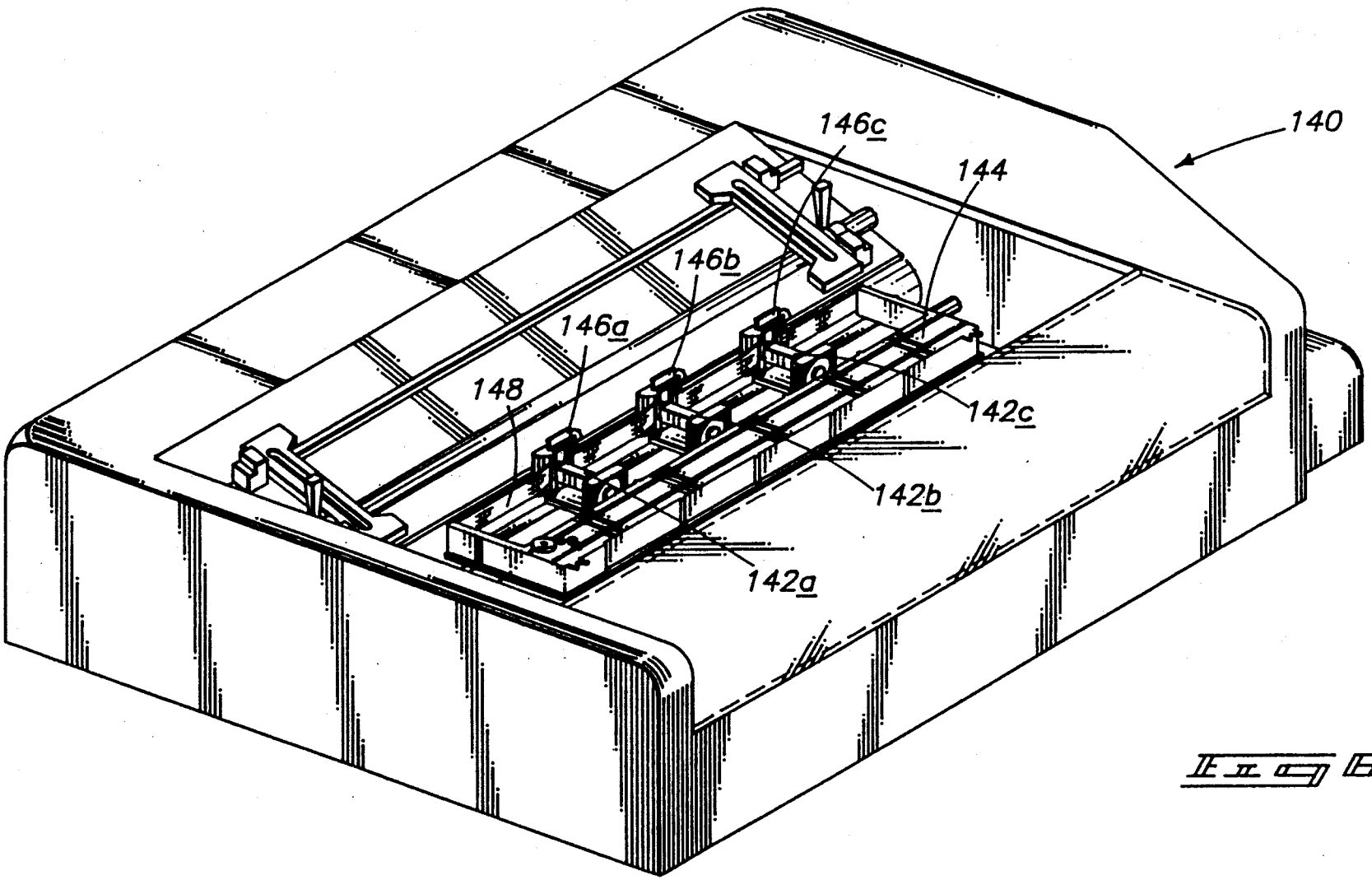
FIG. 6 shows a printer having multiple print heads and the printer ribbon cartridge of the present invention.

FIG. 6 shows a dot matrix printer 140 having three print heads 142*a*, 142*b*, and 142*c* and a printer ribbon cartridge 144 according to the present invention. The three print heads 142*a*, 142*b*, and 142*c* are mounted on a reciprocating print head carriage and are identical to the print head described with reference to FIG. 3. The printer ribbon cartridge 144 has three ribbon guides 146*a*, 146*b*, and 146*c* which are secured to corresponding print heads 142*a*, 142*b*, and 142*c*. The ribbon guides 146*a*, 146*b*, and 146*c* guide the exposed print section of the print ribbon 148 over the fronts of the print heads 142*a*, 142*b*, and 142*c*.

In compliance with the statute, the invention has been described in language more or less specific as to structural features. The invention is not, however, limited to the specific features shown, since the means and construction herein disclosed comprise a preferred form of putting the invention into effect. The invention is, therefore, claimed in any of its forms or modifications within the proper scope of the appended claims appropriately interpreted in accordance with the doctrine of equivalents.

I claim:

1. A computer printer ribbon guide assembly for a printer having at least one print head, the printer ribbon guide assembly comprising:

a ribbon guide for coupling to and defining a path for an exposed print section of a print ribbon; and guide support means mounted adjacent to, but spaced from, a nose section of the print head, the support means having at least one supporting element;

the ribbon guide having fastening means in an installation direction, for releasibly securing the ribbon guide to the supporting element so that the ribbon guide is held in a fixed position in front of the nose section of the print head.

2. The computer printer ribbon guide assembly as defined in claim 1 wherein the guide support means includes upright supporting elements which extend upright on opposite sides of the nose section of the print head.

3. The computer printer ribbon guide assembly as defined in claim 2 wherein the ribbon guide has collars adapted to receive the supporting elements.

4. A computer printer ribbon guide assembly for a printer having at least one print head, the printer ribbon guide assembly comprising:

at least one support rod mounted adjacent to, but spaced from, a nose section of the print head; and at least one ribbon guide for coupling to an exposed print section of a print ribbon, the ribbon guide comprising:

a plurality of members which define a path to receive the exposed section of the print ribbon;

a top platform and a bottom platform disposed at opposing ends of the members, the top platform having a slot formed therein; and at least one collar defining an opening suitable to receive the support rod and having a central axis passing therethrough, the slot formed in the top platform being positioned above the collar such that the central axis passes through the slot.

5. The computer printer ribbon guide assembly as defined in claim 4 wherein the ribbon guide further comprises a primary lip disposed along a first side of the slot and a secondary lip disposed along a second side of the slot opposite the first side.

6. A computer printer ribbon guide assembly for a printer having at least one print head, the printer ribbon guide assembly comprising:

at least one support rod mounted adjacent to, but spaced from, a nose section of the print head, the support rod comprising a first cylindrical section aligned along an axis and having a first diameter, a second cylindrical section aligned along the axis and adjacent the first cylindrical section, the second cylindrical section having a second diameter less than the first diameter, and a conical section aligned along the axis and adjacent the second cylindrical section; and at least one ribbon guide for coupling to an exposed print section of a print ribbon, the ribbon guide having a plurality of members and at least one collar, the members defining a path for receiving the exposed print section of the print ribbon, the collar defining an opening for receiving the support rod, the ribbon guide further having means for releasibly fastening in an installation direction, said ribbon guide to said support rod after the support rod has passed through the corresponding collars to fixedly support the ribbon guide in front of the nose section of the print head.

7. A computer printer ribbon guide assembly for a printer having at least one print head, the printer ribbon guide assembly comprising:

two substantially parallel support rods mounted on opposite sides of, and spaced from, a nose section of the print head; and a ribbon guide for coupling to and defining a path for an exposed print section of a print ribbon, the ribbon guide having two collars and an engagement slot positioned above the two collars, the collars defining openings for receiving corresponding ones of the support rods, and means for releasibly fastening in an installation direction, said ribbon guide to said support rods after the support rods have passed through the corresponding collars to fixedly support the ribbon guide in front of the nose section of the print head.

8. A computer printer ribbon guide assembly for a printer having at least one print head, the printer ribbon guide assembly comprising:

at least one support element mounted adjacent to, but spaced from, a nose section of the print head;

a ribbon guide releasibly mountable to the support element for guiding an exposed print section of a print ribbon over the nose section of the print head; and means comprising a detent for releasibly securing the ribbon guide to the support element.

9. The computer printer ribbon guide assembly as claimed in claim 8 wherein the detent means comprises complimentary first and second attachment means for releasibly engaging one another, the first attachment means being an integral part of the support element and the second attachment means being an integral part of the ribbon guide.

10. The computer printer ribbon guide assembly as claimed in claim 8 wherein the detent means comprises:

an indentation in the support element; and indentation engagement means forming an integral part of the ribbon guide for mating with the indentation in the support element when the ribbon guide is mounted onto the support element.

11. A computer printer ribbon guide assembly for a printer having at least one print head, the printer ribbon guide assembly comprising:

first and second support elements mounted adjacent to, but spaced from, a nose section of the print head, the support elements being resiliently displaceable from a first position to a second position;

a ribbon guide releasibly mountable to the first and second support elements for guiding an exposed print section of a print ribbon over the nose section of the print head; and fastening means for releasibly securing the ribbon guide to the support elements by displacing the support elements from their first position to their second position while the ribbon guide is being mounted to the support elements and allowing the support elements to spring back toward their first position once the ribbon guide is properly mounted to secure the ribbon guide to the support elements.

12. The computer printer ribbon guide assembly as claimed in claim 11 wherein the ribbon guide is released from the resilient first and second support elements by displacing the support elements to their second position.

13. The computer printer ribbon guide assembly as claimed in claim 11 wherein the ribbon guide is mounted to and released from the support elements in a substantially vertical direction.

* * * * *